United States Patent [19]

Johnson

[11] 3,986,661

[45] Oct. 19, 1976

[54] PLASTIC BAG FOR ASEPTIC PACKAGING OF FOOD PRODUCTS

[75] Inventor: William P. Johnson, Queretaro, Mexico

[73] Assignee: Gerber Products Company, Fremont, Mich.

[22] Filed: May 30, 1975

[21] Appl. No.: 582,326

[52] U.S. Cl. ..... 229/53; 150/12; 229/62; 248/95

[51] Int. Cl.[2] ..... B65D 31/00

[58] Field of Search ..... 150/117, 118, 12; 248/95, 99, 100; 229/53, 54 R, 62; 426/110

[56] References Cited

UNITED STATES PATENTS

| | | | |
|---|---|---|---|
| 2,800,269 | 7/1957 | Smith | 206/219 |
| 3,352,411 | 11/1967 | Schwarzkopf | 229/54 R |
| 3,543,999 | 12/1970 | Kugler | 229/56 |
| 3,606,137 | 9/1971 | Kugler | 229/55 |
| 3,774,837 | 11/1973 | Franson | 229/54 R |
| 3,776,372 | 12/1973 | Lemelson | 229/54 R |
| 3,858,789 | 1/1975 | Verbere | 150/12 |
| 3,865,235 | 2/1975 | Levy et al. | 206/286 |

FOREIGN PATENTS OR APPLICATIONS

| | | | |
|---|---|---|---|
| 1,216,929 | 12/1970 | United Kingdom | 229/54 |

*Primary Examiner*—William Price
*Assistant Examiner*—Bruce H. Bernstein
*Attorney, Agent, or Firm*—Townsend and Townsend

[57] ABSTRACT

A plastic film bag for the aseptic packaging of food products in puree form for storage prior to use in a canning process. The bag is formed from a section cut from a roll of plastic film in the form of a continuous cylinder. The cylindrical section is flattened to form a generally rectangular envelope having two faces bounded by two closed edges and two open edges. One of the open edges is sealed to form a bottom seam and the other is folded over and sealed to one face of the envelope in such a way as to form two side entry pockets of triangular shape extending along the upper edge of the bag toward the vertical centerline. A filling aperture is cut in the upper edge midway between the pockets. During the packaging operation a hanger dowel is inserted into each pocket from the side to suspendably support the bag during automatic handling steps including filling, sealing, heat sterilization and cooling. The bag is filled with hot puree through the opening and then hermetically sealed. The hanger dowels are lowered to immerse the sealed bag into a bath of hot water for sterilization of the contents. The bag is then removed from the bath and allowed to cool on the hanger dowels after which it is manually removed and transferred to a storage location.

4 Claims, 7 Drawing Figures

PLASTIC BAG FOR ASEPTIC PACKAGING OF FOOD PRODUCTS

The present invention relates to plastic film bags and is more particularly directed to a plastic bag suitable for containing food products in puree form for storage prior to use in a canning process and to a method of aseptically packaging puree in such bags.

In the food canning industry it is often impractical to store fresh fruit and vegetables prior to use in the canning process. This may occur, for example, because of space limitations or due to unsuitable environmental conditions. In such situations fruits and vegetables are commonly stored in puree form prior to introduction into the canning process. The puree is typically stored in metal containers such as five gallon cans. The disadvantage of using cans, however, is that it is difficult to ensure sterilization conditions within the can when it is filled.

The present invention eliminates this problem through the use of a heat sealable plastic bag of novel construction which is used to hold the puree until it is needed. The design of the bag permits it to be easily and quickly suspended in a vertical position for automatic filling, sealing and sterilization to accomplish aseptic packaging. After packaging the bag is allowed to cool and then stored at ambient temperatures. The use of such plastic bags facilitates quick heating and cooling because of its flexibility and large surface area to volume ratio. The bags are also reusable, thus effecting a cost savings over conventional methods of storage such as cans.

Other objects, features and advantages of the present invention will become more readily apparent after reading the following detailed description with reference to the accompanying drawings wherein.

Figure 1:
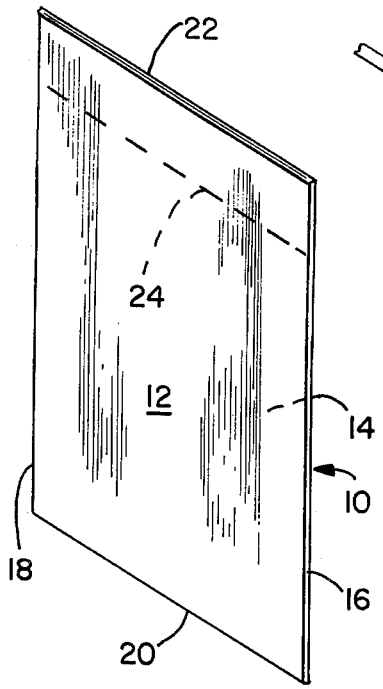
FIG. 1 is a perspective view of a preferred embodiment of the rectangular envelope which is folded and sealed to form the bag of the present invention.
Figure 2:
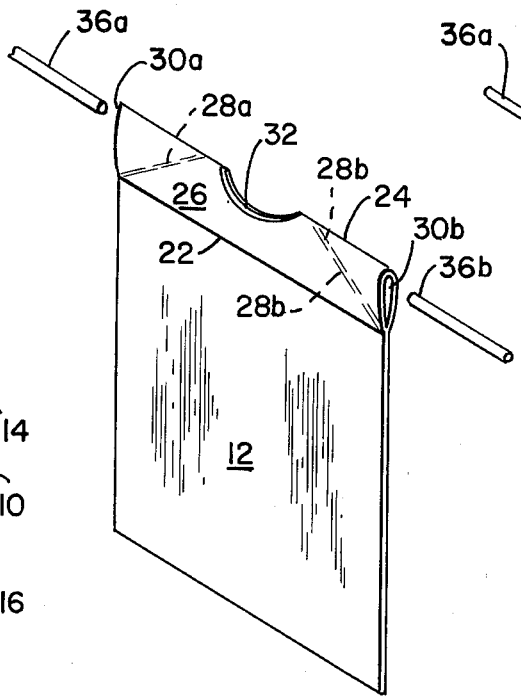
FIG. 2 illustrates the bag of the present invention just prior to insertion of the two hanger dowels which suspendably support the bag during the packaging operation.

Referring now to the drawings, a plastic bag according to a preferred embodiment of the present invention is generally designated at 10.

The bag is formed from a section of heat sealable plastic film in the form of a continuous cylinder. Such material is commercially available in roll form and is of the type commonly used in the packaging industry. The cylindrical section is flattened so as to adopt a generally rectangular envelope including a front fact 12 and a back face 14 which are joined to one another along opposite side edges 16 and 18. Side edges 16 and 18 thus correspond to the longitudinal side edges of the continuous cylinder as it comes off the roll.

After this section has been cut from the roll faces 14 and 16 are sealed to one another along transverse open edge 20 to form the bottom seam of the bag and the opposite transverse open edge 22 is folded over one of the faces of the bag, for example face 12, along fold line 24. Thus, the material between fold line 24 and edge 22 which overlies face 12 forms a generally rectangular fold-over flap 26. Flap 26 is sealed to face 12 along diagonal seal lines **28*a* and 28*b* to form a pair of side entry pockets of generally triangular shape 30a and 30*b*. Each pocket extends from a corresponding side of the bag along fold-over line 24** towards the center of the bag a distance of approximately one-third the transverse dimension of the bag.

Figure 3:
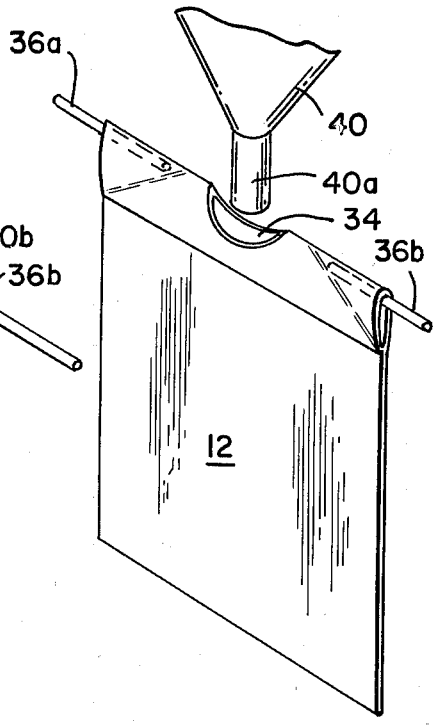
FIG. 3 illustrates the bag with the hanger dowels in position and a pour spout being lowered into the bag through the filling aperture.
Figure 4:
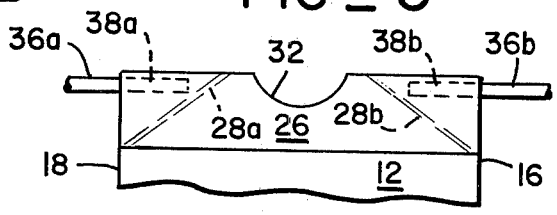
FIG. 4 is a partial side elevation view of the top of the bag showing the formation of the hanger pockets and position of the dowels therein.

After flap 26 is folded over and secured to face 12 along lines 28a and 28b a semi-circular cut-out 32 is made along fold line 24 approximately midway between pockets 30a and 30b to form an aperture 34 (see FIG. 3) through which the bag is filled during the packaging operation which proceeds as follows.

Figure 5:
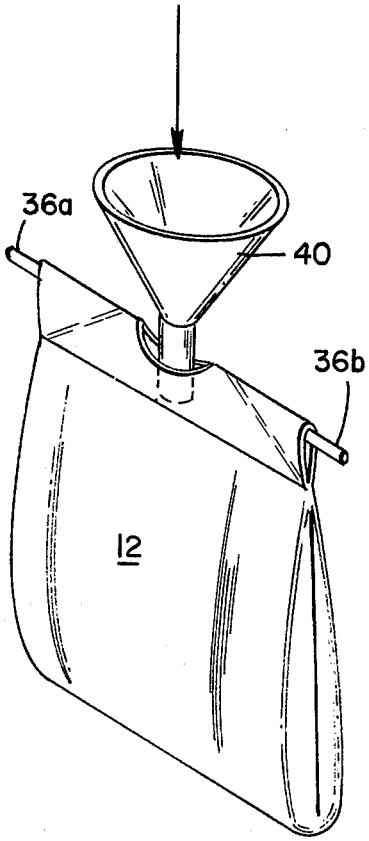
FIG. 5 illustrates the bag during the filling step.
Figure 6:
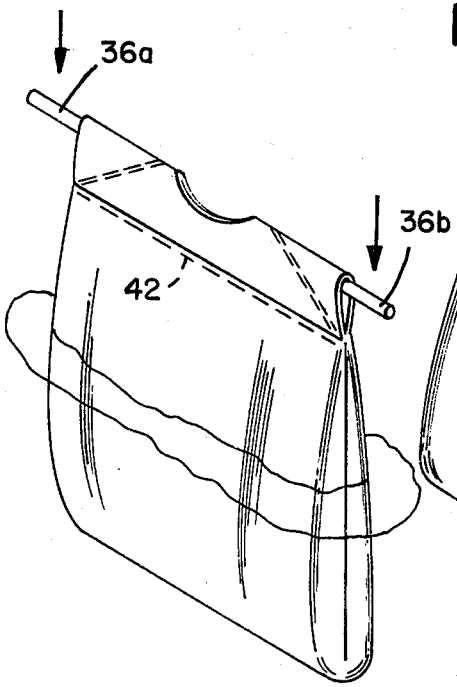
FIG. 6 illustrates the sealed bag being lowered into a bath of hot water for sterilization.
Figure 7:
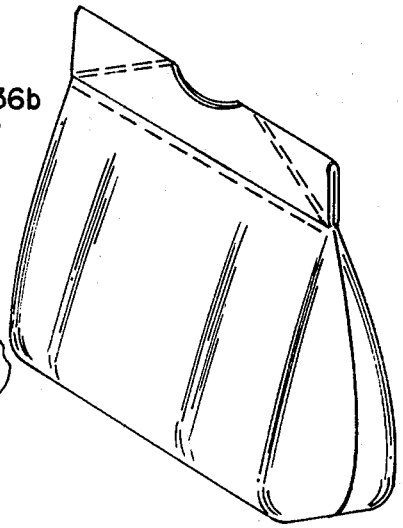
FIG. 7 illustrates the filled, sealed and sterilized bag ready for storage.

A pair of hanger dowels **36*a* and 36*b* are inserted into hanger pockets 30*a* and 30*b* respectively from the sides so as to suspendably support the bag along interior horizontal surfaces 38*a* and 38*b* of the respective pockets. As the dowels are moved inwardly toward one another filling aperture 34 is urged open and pouring spout 40 is lowered so that its discharge nozzle 40*a* enters the bag through aperture 34. The bag is thus filled with hot puree via pour spout 40 at a temperature sufficient to sterilize the product such as, for example, 185–195° F. The filling step is depicted in FIG. 5.**

When the bag is full, pour spout 40 is retracted upwardly and the bag is hermetically sealed along closure line 42 which is just beneath edge 22 of fold-over flap 26.

After the sealing step hanger dowels 36 are moved downwardly lowering the sealed bag into a tank 44 containing hot water at a temperature sufficient to sterilize the bag contents by heat transfer through faces 12 and 14. After sterilization the dowels are moved upwardly raising the bag out of the bath and the bag is then allowed to cool. It will be noted that the use of a plastic bag as described above increases the heat transfer rate during the sterlization and cooling operation due to the large surface-to-volume ratio and thermal conductivity of the plastic film material from which the bag is made. After the bag is cooled it is manually removed from dowels 36 and transferred to a suitable storage location until it is needed in the canning process.

I claim

1. A plastic film bag for use in the aseptic packaging of food products in puree form while suspended in a vertical position from a pair of generally horizontal support members, comprising a generally rectangular envelope having a front face and a back face bounded by a bottom edge, a top edge and two side edges, and including a fold over flap portion defined by said top edge and a fold line adjacent said top edge, said flap overlying one of said faces and being secured thereto along two oblique seal lines each extending from a corresponding side edge at a point below the top thereof to said fold line near the middle thereof, said seal lines thus forming a pair of triangular side entry pockets for receiving said support means to suspendably support said bag during automated packaging operations, and an aperture formed in said front and back faces along said fold line between said pockets to provide an opening through which said bag can be filled with food products.

2. The bag of claim 1 wherein said envelope further comprises a flattened section cut from a roll of plastic film material in the form of a continuous cylinder and said side edges correspond to the two longitudinal edges of said roll.

3. The bag of claim 1 wherein said side entry pockets each define a distance approximately one-third the transverse dimension of the bag.

4. The bag of claim 1 wherein said aperture is of semi-circular configuration.

* * * * *